United States Patent [19]

Jürgens

[11] 4,415,316

[45] Nov. 15, 1983

[54] DOWN HOLE MOTOR

[75] Inventor: Rainer Jürgens, Altencelle, Fed. Rep. of Germany

[73] Assignee: Christensen, Inc., Salt Lake City, Utah

[21] Appl. No.: 258,143

[22] Filed: Apr. 27, 1981

[30] Foreign Application Priority Data

May 21, 1980 [DE] Fed. Rep. of Germany ..... 3019308

[51] Int. Cl.[3] ..... F01C 1/107; F01C 5/02; F03C 2/08

[52] U.S. Cl. ..... 418/48; 418/182; 175/107; 403/227; 403/368

[58] Field of Search ..... 418/48, 182, 153, 156; 175/107; 403/368, 374, 361, 227, 267, 334

[56] References Cited

U.S. PATENT DOCUMENTS

| | | | |
|---|---|---|---|
| 2,212,153 | 8/1940 | Eaton et al. | 403/227 X |
| 3,139,035 | 6/1964 | O'Connor | 418/48 X |
| 4,187,061 | 2/1980 | Jürgens | 418/48 |
| 4,315,699 | 2/1982 | Lusk | 403/361 |

FOREIGN PATENT DOCUMENTS

| | | | |
|---|---|---|---|
| 1171748 | 6/1964 | Fed. Rep. of Germany | 418/48 |

*Primary Examiner*—John J. Vrablik
*Assistant Examiner*—Donald E. Stout
*Attorney, Agent, or Firm*—Rufus M. Franklin

[57] ABSTRACT

In a Moineau type fluid motor one of the relatively rotatable elements is made of a deformable material, and axial movement of tapered surfaces within the element, caused by variation in the fluid pressure, causes adjustment of the sealing force in the motor in accordance with the fluid pressure level.

5 Claims, 6 Drawing Figures

DOWN HOLE MOTOR

The invention is concerned with a direct drive motor for cutting tools. Motors of the kind which are based on the Moineau principle find application, to a considerable degree, as direct drives or so-called downhole motors in deep-hole drilling. When used in this manner, they are are provided with an upper connecting end on the housing to serve as a connection with the drill string and drive the boring cutting tool or similar boring tool by means of a universal joint connecting the motor shaft with the boring tool. The flushing fluid is used as energizing medium, being pumped down through the boring tube assembly and entering under high pressure the working space between the housing which forms the stator and the shaft which forms the rotor. In its screw-like path through the motor, a portion of the pressure energy of the energizing medium is transformed into rotational energy for the shaft. The pressure drop inside such motors depends on the constructional design and with cutting tool direct drives of usual construction is on the order of magnitude of 25–60 bar.

The rotor and the shaft of such a motor are constructed as screw-like molded bodies where one of the parts bears an elastically deformable material. Portions of the contour surfaces of the shaft and stator engage each other and form a working space in which the energizing fluid exerts its influence on the contact surfaces which effect the production of torque. For satisfactory operation of the motor, it is important that the contour surfaces of the working space (cavity) are engaged with sufficient sealing, because the performance of the motor decreases with insufficient sealing and does not reach the desired design value. Due to the variable operating conditions in the bore hole, preselection of a standard oversize for the deformable member which determines the magnitude of the contact pressure, cannot be used to permit attainment of optimal results under all operating conditions.

In a known cutting tool direct drive, the contact pressure between the regions of the contour surfaces which are in contact with each other, which determines the effectiveness of sealing, is extensively adjusted to the pressure and temperature conditions of the energizing medium as well as to the load on the cutting tool. This is accomplished by having a molded body arranged in the form of a jacket on the shaft which is constucted as a radially displaceable diaphragm. The molded body produces a contact pressure between the contour surfaces of the shaft and stator which depends on the pressure of the energizing medium or a pressuring medium. This type of contact pressure control, however, only permits a constant pumping action over the entire axial length of the shaft; while the opposite-directed pressure of the flushing fluid in the working space (cavity) decreases from chamber to chamber of a multistage motor, with the result that the pressure is overcompensated in each successive working chamber and axially increasing friction losses result.

The basic problem with which the invention is concerned, therefore, consists of the achievement of a steady contact pressure for the meshing regions of the molded surfaces in a cutting tool direct drive, and thus setting the optimal contact pressure for each chamber with respect to maximal efficiency with minimal wear. This problem is solved in a cutting tool direct drive of the kind described in the overall concept of this invention by the characteristic features built into the construction. In all the designs in accordance with the invention the molded body which is chiefly subject to wear, has an uncomplicated shape which is simple to fabricate and which, therefore, requires, besides low motor manufacturing cost, relatively low maintenance cost. Furthermore, a cutting tool drive motor designed according to the invention reduces the construction expense, since the radial deformation of the formed body is an automatic control mechanism depending on the influence of pressure and cutting tool load, and, therefore, dimensional tolerances are of lesser importance in the fabrication of the molded body.

To achieve the radial deformation, the molded body can be positioned to be both axially displaceable on the shaft, as well as to swivel angularly. The contact surfaces between shaft and molded body which are designed as a kind of oblique plane must, in addition, point in the direction of the predetermined displacement direction. When the formed body is axially displaced on the shaft, the shaft may be fixed axially and the formed body displaced or the reverse. According to a further design, the shaft is divided into several cone shape sections which are made to have a high pitch of the contacting sides. This is done to minimize the interlocking originated hysteresis which occurs due to the displaceability of the molded body on the shaft in both directions.

A further design, according to the invention, provides that the support of the elastic molded body is provided, on and along the side toward the molded body, with ribs arranged to be distributed around the circumference, and the molded body is provided with corresponding grooves over which both are in mutual elastic (fluid form) contact.

Many other construction features and advantages are evident from the claims, which are described in connection with the drawing in which more examples of the execution of the substance of the invention are demonstrated.

In particular:

Figure 1:
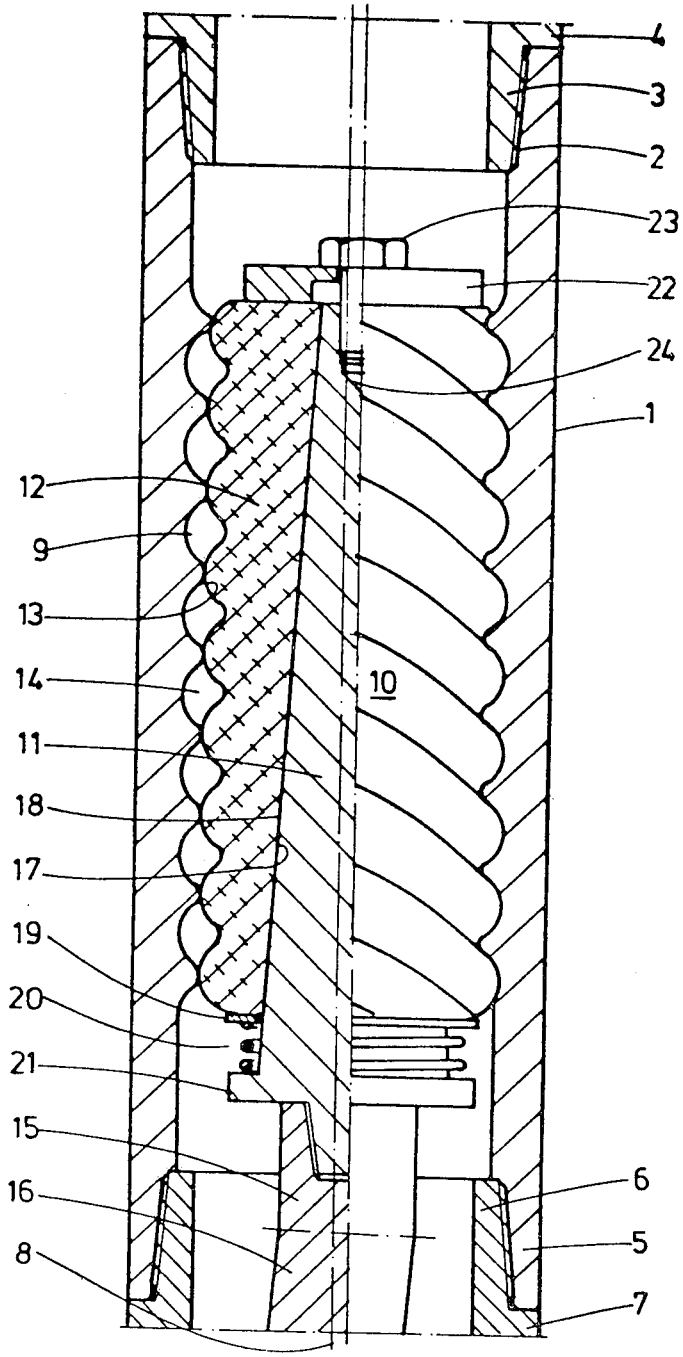
FIG. 1 shows an interrupted longitudinal section through the first way of carrying out construction of a cutting tool drive according to the invention, with the rotor shown partially in cross-section and partially in side view.

The cutting tool direct drive for a deep-boring tool shown in FIGS. 1–5 in detail consists of an external cylindrical housing 1, which has on its upper inlet end a conical inside thread 2 for threading onto the externally threaded shoulder of a tubing section 4. On its lower exit end, the housing 1 has a conical internal thread 5 for threading onto the externally threaded shoulder 6 of a tubing section 7, which accommodates any known suitable bearing arrangement. The parts 1, 4 and 7 in this arrangement are arranged coaxially on a common longitudinal center axle.

On its inside, the housing 1 has a molded surface 9, which, if desired, may be provided with a suitable surface coating to minimize wear, as well as corrosion reduction. The specific design form of the molded surface 9 is defined by screw turns left or right-handed. In the example shown, the molded surface is formed as a ten-turn screw thread. In the illustrated example, the housing 1 is shown as a stator.

A shaft is positioned in the housing 1. This shaft which is rotatable and, to a limited degree, radially displaceable in the housing, forms a rotor and the whole is designated as 10. The shaft consists of a core piece or support 11 of steel or similar material and of a shaft covering 12 of an elastomer, i.e., rubber, polyurethane, etc. The latter may be reinforced, if desired, by a perform made of elastomeric material filled with glass fibers, metal filaments, e.g., steel wires, or similar materials. On its exterior, the shaft covering 12 is provided with a molded surface 13. Its shape is coordinated with the molded surface 9 of the housing 1 and is assembled from spiral thread teeth, which correspond to a nine-turn screw thread in the illustrated example. It is understood that, provided the known required difference in the number of turns is adhered to, a different number may be chosen corresponding to current requirements. It is further understood that, instead of the illustrated single-handedness of the spiral path, a two or other suitable multi-handedness may be provided. The molded surfaces 9, 13 intermesh with one another in the manner of helical gearing and together bound a cavity 14, which, in the case of multi-turn rotor/stator design, is composed of a corresponding number of helical canals. On its lower side, the support 11 of the shaft 10 is connected with an intermediate shaft 16 by way of a universal joint 15 or similar element. The unillustrated lower end of the intermediate shaft is supported on a rotatable part located coaxially to axle 8 by means of a universal joint or similar element. The boring tool may be connected with this part. The intermediate shaft 16 forms the only axial support of the shaft 10 and permits this shaft to make the eccentric wobbling motion required for the mechanism to function in operation.

The molded body which forms the shaft jacketing 12 is made of an elastic material and is supported on the shaft core or support 11. While the support 11 has a cone shaped outer surface 17, radially expanding toward the bottom, the molded body 12 possesses a complimentarily shaped inner surface 18. A mutual axial displacement between shaped body and support against the widening outer surface results in a radial stretching of the elastic molded body 12 and with this, a higher contact pressure between the shaped surfaces 13 of the molded body and the molded surfaces 9 of the housing 1. On its lower end, the molded body 12 is supported on a shoulder 21 of the support 11 by way of a disc 19 and a coil spring 20. On the upper end, the molded body 12 is prestressed by a clamping collar 22 on the front face of the molded body. This prestressing may be adjusted by one or more self-locking screws whose threads are screwed into blind end holes 24 and whose head presses on the clamping collar 22.

Figure 2:
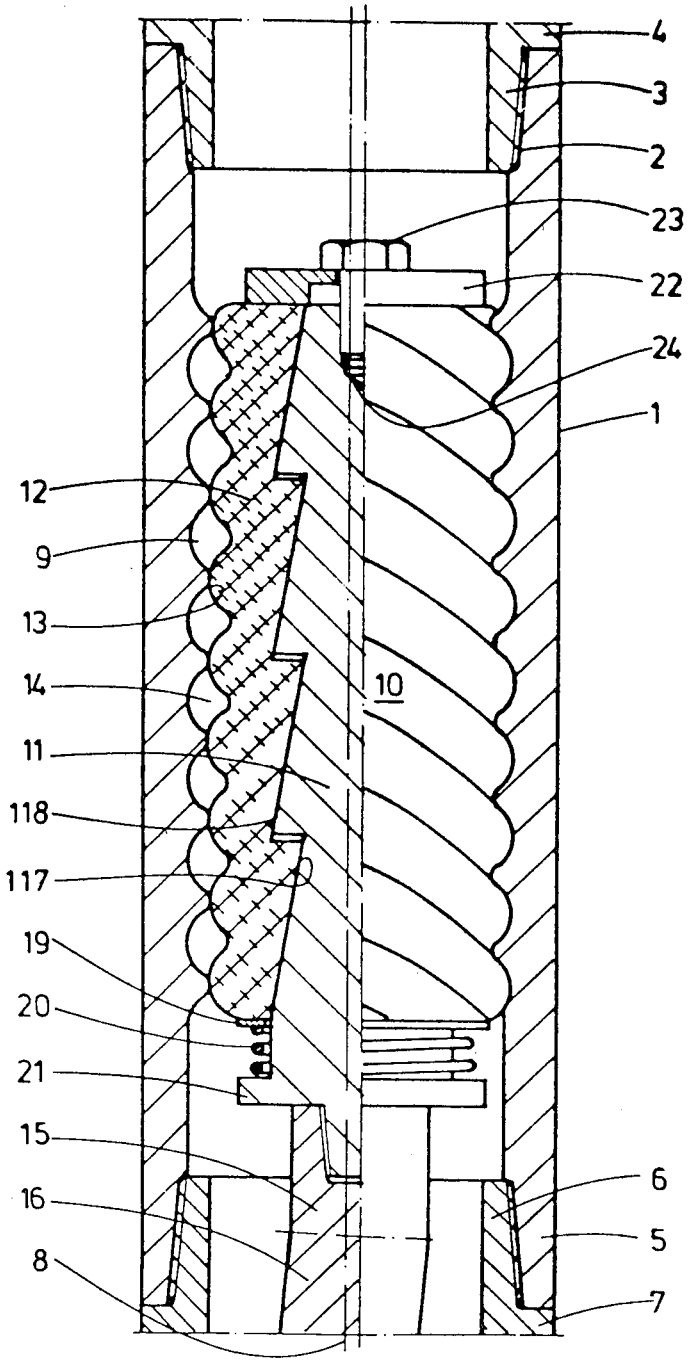
FIG. 2 shows a cross-sectional view similar to FIG. 1 of a modified, second execution.

The execution of the substance of the invention illustrated in FIG. 2 is different in the design of the outside surface of the support 11 and the inner surface of the molded body 12 from those of FIG. 1. While the above-named surfaces are designed as one-piece cones in FIG. 1, the support 11 illustrated in FIG. 2 shows a many-piece cone exterior surface 117 (in the execution example 4-stage) and the complementary mating piece 118 is shown on the inner side of the molded body 12. The division into many cone segments permits the choice of a higher lead angle between the sliding surfaces of support and molded body.

A higher lead angle lessens the danger of the molded body's self-locking upon its return to the initial position after a drop in the axial pressure to which it was subjected.

Furthermore, this form of execution permits the force on the wall of the molded body to remain relatively constant when the whole length of the shaft is considered. This results in a favorable even distribution of contact pressure between the contact surfaces 13,9 of the molded body and the housing when the axial pressure acts upon the molded body.

If an energizing medium in the form of a flushing fluid is pumped downward through the drill string, the energizing fluid flows through the cavity 14 while impressing a turning motion on the shaft 10. Because of the throttling effect of the motor on the pressure of the flushing medium, the pressure in the bore tube assembly below the motor is lower than that in the drill string above the motor. The front face of the molded body 12 which is exposed to the higher pressure in the upper drill string, therefore, attempts to deflect in the flow direction. A widening of the shaped body occurs as a result of the sliding of the shaped body along the support. This leads to a higher contact pressure between the contact surfaces 13,9 of the shaped body of the shaft jacketing and the housing. Because of the slope of the cone and the action of the spring 20, a certain counter force is built up which rises until its axial component reaches equilibrium with the force which results from the pressure difference between the upper and the lower tube assembly portions. With proper design of the motor, this equilibrium can be adjusted for all required operating conditions, so that the contact pressure always has an optimal value with respect to the sealing required for the torque output and for the lowest possible wear. An adjustable pretension by means of the screw 23 provides for the face that, even at low pressures or during pressure drops, sufficient sealing action is available to permit effective regulation without hesitation when the pressure and load increase.

Because the friction between the molded body 12 and the support 11, occasioned by insufficient slope of the tapered outside surface, can hinder contractile return of the molded body to its axial initial condition, it is necessary to provide for sufficient slope between the contact surfaces of molded body and support. Because of the limited radial space which would permit this slope to be effectuated, division into several uniform conical sections is a suitable solution possibility. Hysteresis between extension and contraction of the support 12 when the pressure rises and falls is minimized thereby and the control behavior is improved.

Figure 3:
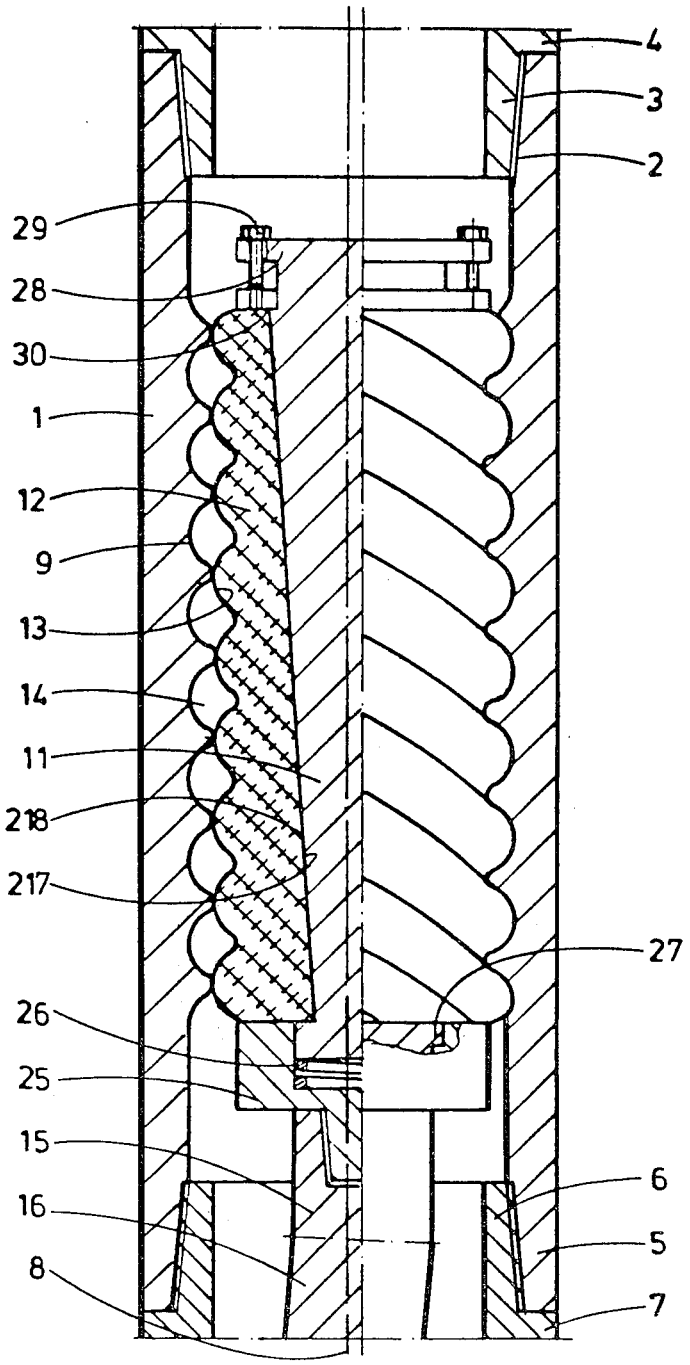
FIG. 3 shows a cross-sectional view in which the arrangement of the stationary part and the displaceable part is interchanged in contrast to FIG. 1.

In the form of execution depicted in FIG. 3 similarly to FIG. 1, a single-part cone 217 is installed as support 11 and the complementary inner shape 218 of the molded body is provided. In contrast to the way FIG. 1 is carried out, however, an axially immovable supported molded body 12 which is completed by an axially movable support 11 is provided here. The lower front surface of the molded body 12 rests on the front surface of the wall of a sleeve 25, which has interior grooves running in the axial direction in its interior. The corresponding springs 27 of the support 11 engage these grooves. The lower front surface of the support 11 is supported against the floor of the sleeve 25 through a helical spring 26. The upper end of the support 11 is formed approximately like the shoulder 28 projecting from the molded body 12. Several screws 29 are guided through the shoulder, the other side of support 11 is provided here. The lower front surface of the molded body 12 rests on the front whose threads are screwed into holes or into a ring 30 which is connected to the shaft jacketing. By means of these screws, the support 11 may be pretensioned axially against the pressure of the spring 26 and the contractile forces of the molded body 12.

The form of execution illustrated in FIG. 4 contains a combination of the characteristics described in connection with FIG. 2. and FIG. 3. On the one hand, the contact surfaces 317,318 between the support 11 and the molded surface 12 are designed as a multistep cone; on the other hand, as described in FIG. 3, the molded body 12 is supported so that it cannot slide axially, while the support 11 is fixed radially in a sleeve/spring-tooth system but arranged to be able to slide axially.

Figure 4:
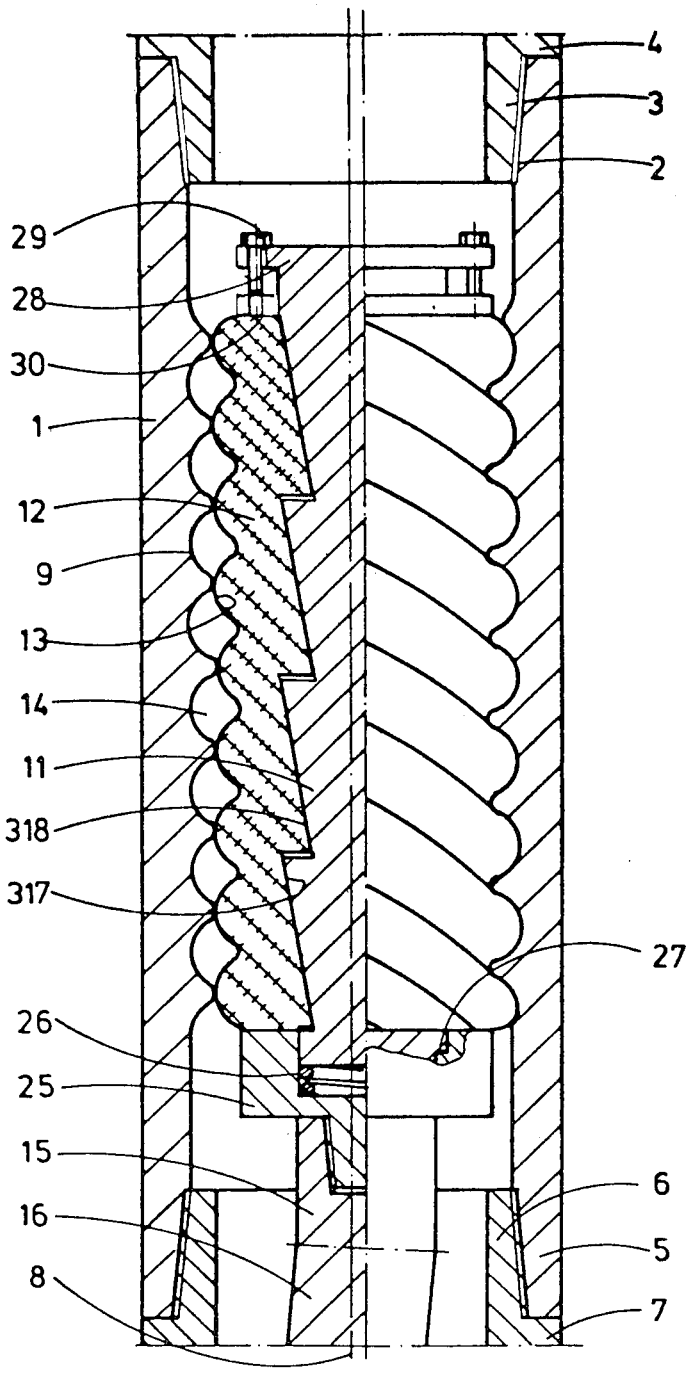
FIG. 4 shows a representation in which the arrangement of the stationary and the displaceable part is interchanged in contrast to FIG. 2.
Figure 5:
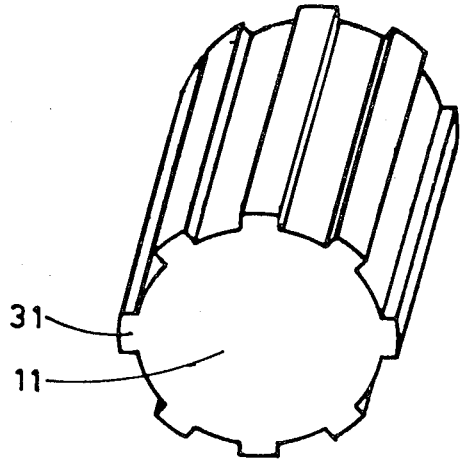
FIG. 5 shows a three-dimensional representation of a section of the support as it can be utilized as a further design feature for the examples of FIGS. 1–4.

The advantage of the form of execution illustrated in FIGS. 3 and 4 with a molded body not able to slide axially lies in the constant phase relationship between the shaped surfaces 9,13 of the shaft 10 and the housing 1 under all operating conditions. But this means the exact alignment which is required to achieve performance output according to design is guaranteed.

Because the motor torque is transmitted to the surfaces of the shaft jacketing which are in contact with the energizing medium and transmitted over the shaft core, the universal joint and further intermediate shafts to the boring tool, the connecting surfaces between the shaft jacketing and the shaft core must be fabricated so that they can transmit the torque. If the adhesive friction with a smooth surface is insufficient, and, moreover, the danger of distortion of the molded body 12 exists, then, according to FIG. 5, the support 11 may be provided on its outer side with ribs 31 which are arranged to be distributed over the circumference, and the back side of the molded body, which is not illustrated here, provided with corresponding slots over which both are in mutual positive contact. A multiwedge or spline joint of this type insures that, regardless of the occurrence of radial or axial displacement motions, steady, evenly distributed transmission of torque occurs, with the exclusion of relative turning motion with respect to each other, as well as with the exclusion of uncontrolled deformations and twisting distortions, in particular, regions or zones of the molded body.

Figure 6:
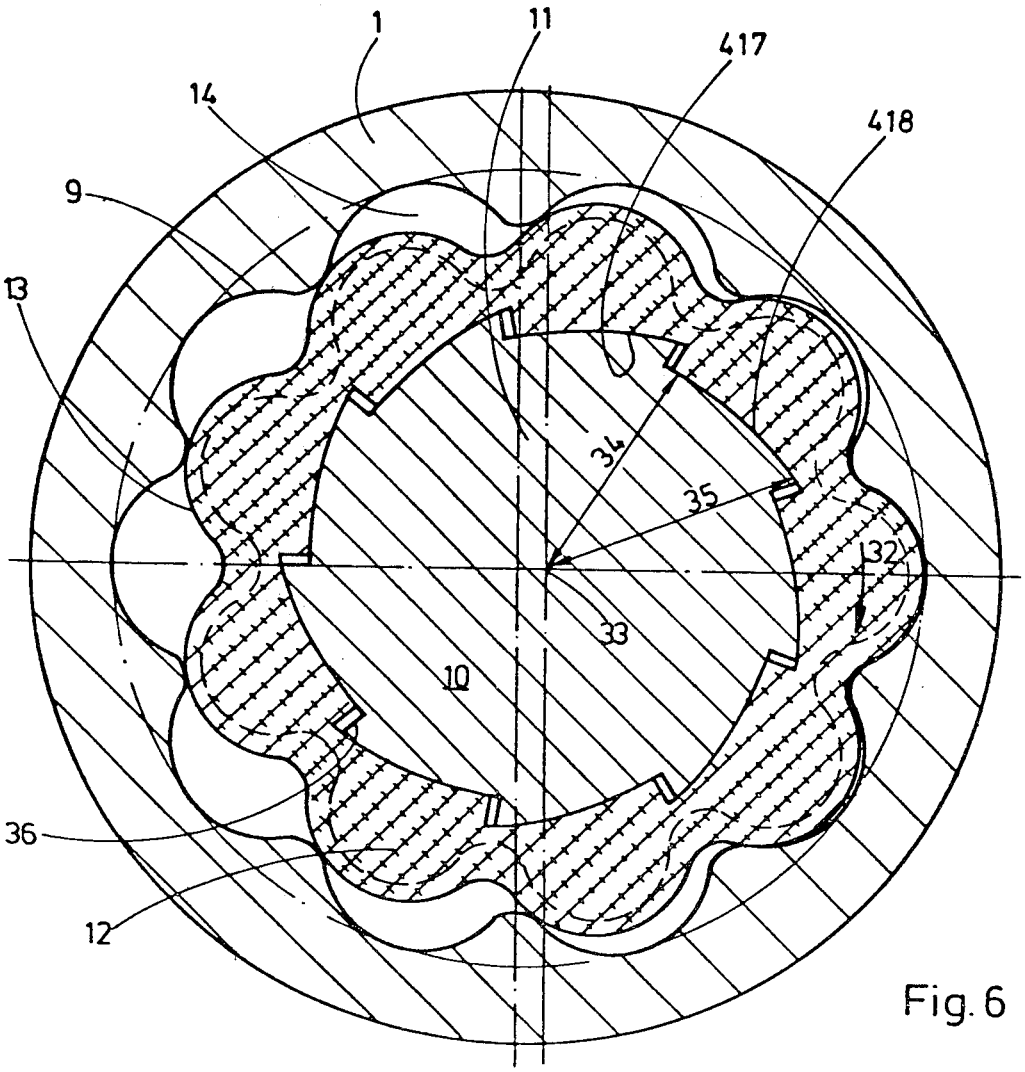
FIG. 6 shows a cross-section through a fifth example of a cutting tool direct drive.

FIG. 6 illustrates a further advantageous design of the substance of the invention and is distinguished from the versions illustrated in FIGS. 1–4 by the different directional sense of the slope between the contact surfaces 417,418 of the support 11 and the molded body 12. The slope of the contact surfaces 417,418 is made to occur here in a circular manner, so that the outside surface of the support 11 and the corresponding inside surface 418 of the complementarily formed molded body 12 shows a profile which is formed to be a direction barrier, as in a saw-gear, although, of course, there is no functional correspondence with such an arrangement. The support displays several raised portions which are gear-like in cross-section. These are distributed evenly on the circumference and extend along the support. The tooth-like contour is formed in a manner such that the course of the tooth surfaces regarded in the sense of the direction of rotation 32 continuously increases from a minimum clearance 34 to a maximum clearance from the shaft center 33. The connecting line 36 between the tooth flank point 35 of one tooth flank furthest from the shaft axis 33 to the point 34 closest to the shaft axis 33 on the neighboring tooth flank runs in the direction of the shaft radius or at a nose angle to it. Most advantageously, the number of tooth-like elevations are chosen to be equal to the number of screw threads. The flank surfaces which extend along the shaft axis can proceed axial or, for example, follow the spiralling of the outside surface of the molded surface. The flank lead angle, measured between a tangent parallel to the course of the flanks and a line which runs vertical to the shaft radius from the same viewing point, is chosen to be greater than the frictional angle $\delta$ of the coefficient of friction between the materials of construction of the shaft 11 and the molded body 12. The support 11 and the molded body 12 are fixed so that they cannot slide in an axial direction.

If energizing fluid is pumped through the motor to drive a boring tool, a torsional force is built up on the face surfaces 13 of the molded body 12 by the pressure of the energizing fluid. This torque is supplied to the bore tool over the flat running flanks 417,418 of the gearing between molded body 12 and support 11 over the bearing 15 and the intermediate shaft 16. As soon as a corresponding counter torque arises due to high loading of the bore tool, the case may occur that the adhesive friction between the molded body 12 and the support 11 on the saw-tooth flanks 417,418 becomes too small and the molded body 12 is twisted. Then the inside of the molded pressure on the flat saw-tooth shaped flanks 417 of the support 11 and on the shaped surfaces 9 of the housing 1. This contact pressure is brought about on the one hand by the tendency of the molded body 12 to contract, on the other hand, by the back pressure between the contact surfaces 13,9 of the molded body with the outer ring. The adhesive frictional force required to drive the support 11 is increased in this manner and, at the same time, sealing of the working fluid in the cavity 14 is enhanced. When the loading moment is removed, the molded body 12 resumes its starting position on the support 11 or upon a lesser reduction it assumes an intermediate position.

The above-named form of execution combines many advantages of the examples of execution explained at the beginning. Thus, loading does not change of influence the phase relationship between the molded surfaces of shaft and housing because the axial positions of support and molded body are fixed. An interlock of the displacement of the shaft jacketing upon the outer surface of the core can be eliminated by suitable choice of the slope of the flanks of the teeth. Furthermore, separate slots to transmit torque positively between molded body and support may be eliminated, since this function has already been taken over by the combined form and friction fitting coupling of the saw-tooth-like contact surfaces. The pressure difference between the inlet and exit of the energizing fluid is used as the control force for the contact force of the molded surfaces of the shaft on the molded surface of the housing in the five described forms of practicing the substance of the invention. In the forms of execution described in FIGS. 1–4, the controlling force operates in an axial direction while it is redirected in a tangential direction on the surface of engagement of the jacketing in the motor cavity. In all cases, a load dependent shifts results from this, so that the sealing effect for the required torque is just achieved and the wear phenomena are held to an essential minimum.

If, in the above, the invention is described as being based on motors which form direct drive cutting tools, it is to be understood, however, that motors developed according to the invention are not limited to such preferred area of application. On the contrary, it may be used in other areas of application in which analogous operating conditions apply. Besides the application as a cutting tool direct drive, described in detail above, the drive can be applied basically for all rotating drive applications as may be required in any given case in a bore hole or bore tube.

What is claimed is:

1. Cutting tool direct drive moineau motor for deep-hole boring tools, consisting of a housing which a fluid can stream through in an axial primary direction from an inlet end to an outlet end and a shaft located in the housing which is rotatable and, to a limited extent, radially displaceable; the shaft and housing having molded surfaces turned toward each other which engage one another at contacting surfaces in the manner of helical gearing and mutually defining a cavity for a liquid or gaseous working (energizing) medium, which, during a passage through the cavity, traces a current path which approximates a helical path which is at least single-threaded and at least single stage; one of the two molded surfaces being formed into a molded body made of an elastically deformable material and being supported internally by a support member; characterized by the fact that the molded body and the support are displaceable when fluid pressure acts upon the motor; and that the contact surfaces of the elastically deformable molded body and the support member are sloped in a direction whereby the molded body is expanded thereby adjusting the seating action of the motor to the pressure of the energizing fluid.

2. Cutting tool direct drive according to claim 14, characterized by the fact that, the support member is positioned so that it cannot slide axially and displays a conical shape which widens at its lower end, and that the molded body, with its complementary inner surface lies adjacent to and is axially displaceable on the support member, is supported by springs on its lower end and can be prestressed axially against said springs on its upper end by an adjustable prestressing ring on its upper end.

3. Cutting tool direct drive according to claim 2, characterized by the fact that, the support displays a multipiece coaxially and successively connected conical surface; and the inner surface of the molded body exhibits a form complementary to the support.

4. Cutting tool direct drive according to claim 2 characterized by the fact that the support of the elastically deformable molded body is provided with ribs which are distributed over the circumference of the support on and along the side toward the molded body and that the molded body is provided on its back side with corresponding slots in which both parts are in mutual positive contact.

5. Cutting tool direct drive according to claim 1, characterized by the fact that the support of the elastically deformable molded body is provided with a saw-tooth-like profile on and along its side facing the molded body the profile of which viewed in the direction of rotation rises continuously in each case between a minimum distance and a maximum distance from the axis of the shaft; and that the side of the molded body facing the support displays a profile formed complementary to the saw tooth-like profile.

* * * * *

UNITED STATES PATENT AND TRADEMARK OFFICE

CERTIFICATE OF CORRECTION

PATENT NO. : 4,415,316

DATED : Nov. 15, 1983

INVENTOR(S) : Rainer Jürgens

It is certified that error appears in the above-identified patent and that said Letters Patent is hereby corrected as shown below:

In Claim 2 line 1 change "14" to --1--.

Signed and Sealed this

*Twentieth* Day of *August 1985*

[SEAL]

*Attest:*

DONALD J. QUIGG

*Attesting Officer* *Acting Commissioner of Patents and Trademarks*